US006357892B1

(12) United States Patent
Beadle

(10) Patent No.: US 6,357,892 B1
(45) Date of Patent: Mar. 19, 2002

(54) LIGHTING FIXTURE WITH BEAM ADJUSTMENT

(76) Inventor: Joshua Beadle, 5362 Caminito Vista Lujo, San Diego, CA (US) 92130

( * ) Notice: Subject to any disclaimer, the term of this patent is extended or adjusted under 35 U.S.C. 154(b) by 0 days.

(21) Appl. No.: 09/537,061

(22) Filed: Mar. 28, 2000

(51) Int. Cl.[7] ..... F21V 29/00

(52) U.S. Cl. ..... 362/267; 362/153.1; 362/414; 362/410; 362/431; 362/187

(58) Field of Search ..... 362/267, 153.1, 362/410, 187, 353, 354, 355, 414, 431

(56) References Cited

U.S. PATENT DOCUMENTS

| | | | | | |
|---|---|---|---|---|---|
| 4,987,523 | A | | 1/1991 | Lindabury et al. | 362/188 |
| 5,031,080 | A | * | 7/1991 | Aikens et al. | 362/187 |
| 5,075,828 | A | | 12/1991 | Gordin et al. | 362/297 |
| 5,226,721 | A | * | 7/1993 | Stokes | 362/153.1 |
| 5,249,109 | A | | 9/1993 | Denison et al. | 362/285 |
| 5,386,354 | A | | 1/1995 | Osteen | 362/258 |
| 5,459,649 | A | | 10/1995 | Ellion | 362/187 |
| 5,718,506 | A | * | 2/1998 | Yeh | 362/344 |

* cited by examiner

*Primary Examiner*—Sandra O'Shea
*Assistant Examiner*—Ronald E. DelGizzi
(74) *Attorney, Agent, or Firm*—Kilpatrick Stockton LLP; Eleanor M. Musick

(57) ABSTRACT

The outdoor lighting comprises a stem, a socket disposed in the top of the stem for retaining a halogen lamp, a socket housing, a diffuser lens and a reflector top. The socket housing has a lower cylindrical portion having a first inner diameter for fitting over the outer diameter of the upper part of the stem, a second cylindrical portion having a second inner diameter larger than the first inner diameter adapted to closely fit over the outer diameter of the cylindrical diffuser lens. The lower cylindrical portion of the socket housing has a slot extending upward from its bottom edge with a width greater than a diameter of a locking screw that is screwed into a bore in the side of the stem. When the locking screw is loosened, rotation of the socket housing forces an edge of the slot against the locking screw, which converts the rotational motion of the socket housing into an axial motion, causing the socket housing, diffuser and reflector to be raised or lowered relative to the stem, and modifying the beam spread depending on the direction of movement.

22 Claims, 3 Drawing Sheets

LIGHTING FIXTURE WITH BEAM ADJUSTMENT

FIELD OF THE INVENTION

This invention generally relates to an outdoor lighting fixture, and more specifically, to an outdoor lighting fixture with an adjustable focusable beam.

BACKGROUND OF THE INVENTION

Environmental lighting, particularly outdoor lighting, is well known in commercial or public settings, such as parks and schools. Such lighting has also become increasingly popular for use in private residences, both to enhance the appearance and safety of the outdoor area and for security by eliminating hiding places and unobserved entry points for intruders.

Pathlights in landscape and outdoor lighting systems are placed along walkways and stairs to provide illumination for the safety of persons walking on the path in the dark, and may be located in other areas where a broad wash of light is desired, such as in a planter. Typically, such lights will have a diffuser and/or reflector to prevents the light from shining directly upward into the pedestrian's eyes, and avoids the creation of shadow lines, both of which can make navigation of the darkened path even more difficult. Reflectors are used to spread and direct a wash of light down onto the pathway. Adjustment of the beam spread can be varied to minimize glare on uphill views and to maximize beam spread on level ground where glare is not an issue. However, the inclusion of such down-reflectors can limit the ability to adjust the beam spread without removing and/or replacing hardware in the fixture or subjecting the fixture to corrosion due to poor sealing of the housing resulting from the presence of adjustable connections.

It would be desirable to provide a pathlight that allows the amount of glare and/or beam width to be adjusted without introducing components that can result in premature failure of the fixtures as well as providing a lighting fixture that are easily maintained.

SUMMARY OF THE INVENTION

It is an advantage of the present invention to provide a lighting fixture which has a variable beam spread.

It is a further advantage of the present invention to provide a lighting fixture that permits adjustment of beam spread by loosening a single fastener.

Another advantage of the present invention is to provide a lighting fixture that is sealed against moisture intrusion and, thus, resists corrosion.

In an exemplary embodiment, the outdoor lighting comprises a stem, a socket disposed in the top of the stem for retaining a halogen lamp, a socket housing, a diffuser and a reflector top. The socket housing has a lower cylindrical portion having a first inner diameter for fitting over the outer diameter of the upper part of the stem, a second cylindrical portion having a second inner diameter larger than the first inner diameter adapted to closely fit over the outer diameter of the cylindrical diffuser lens, and a flared portion joining the lower cylindrical portion to the upper cylindrical portion. The flared reflector fits over top of the diffuser lens and can be sealed, using silicone or other sealant, to protect the internal surfaces of the lighting fixture from moisture intrusion The lower cylindrical portion of the socket housing has a diagonal slot extending upward from its bottom edge with a width greater than a diameter of a locking screw that is screwed into a bore in the side of the stem to form a bayonet-like fastener. When the locking screw is loosened, rotation of the socket housing forces an edge of the diagonal slot against the locking screw, which converts the rotational motion of the socket housing into an axial motion, causing the socket housing, diffuser and reflector to be raised or lowered relative to the stem, and modifying the beam spread depending on the direction of movement. After the desired beam spread is achieved, the fastening screw can be tightened, locking the assembly in place. The same connection can be used to access the halogen lamp for replacement, thus permitting a single tool to be used for adjustment and maintenance of the fixture.

The socket includes a base connector that has a first outer diameter that closely fits within the inner diameter of the stem, which is a hollow tube. A threaded bore in the side of the base connector that is aligned with a bore through the side of the stem receives the fastening screw. A ceramic socket is attached to and extends from the base connector for attachment of the halogen lamp. Wires are passed through the ceramic socket, base connector and stem for connection to a voltage source. A strain relief knot can be tied in a length of wire running between the ceramic socket and the base connector. The strain relief knot provides a means for preventing the socket wires from being pulled away and disconnected from the socket mount when the fixture is being repositioned.

For installation, the bottom end of the stem has a threaded connector for connection to a spike that can be inserted into the ground.

BRIEF DESCRIPTION OF THE DRAWINGS

For a more complete understanding of the present invention, reference is now made to the following detailed description of the embodiments illustrated in the accompanying drawings, wherein.

DETAILED DESCRIPTION OF PREFERRED EMBODIMENTS

Figure 1:
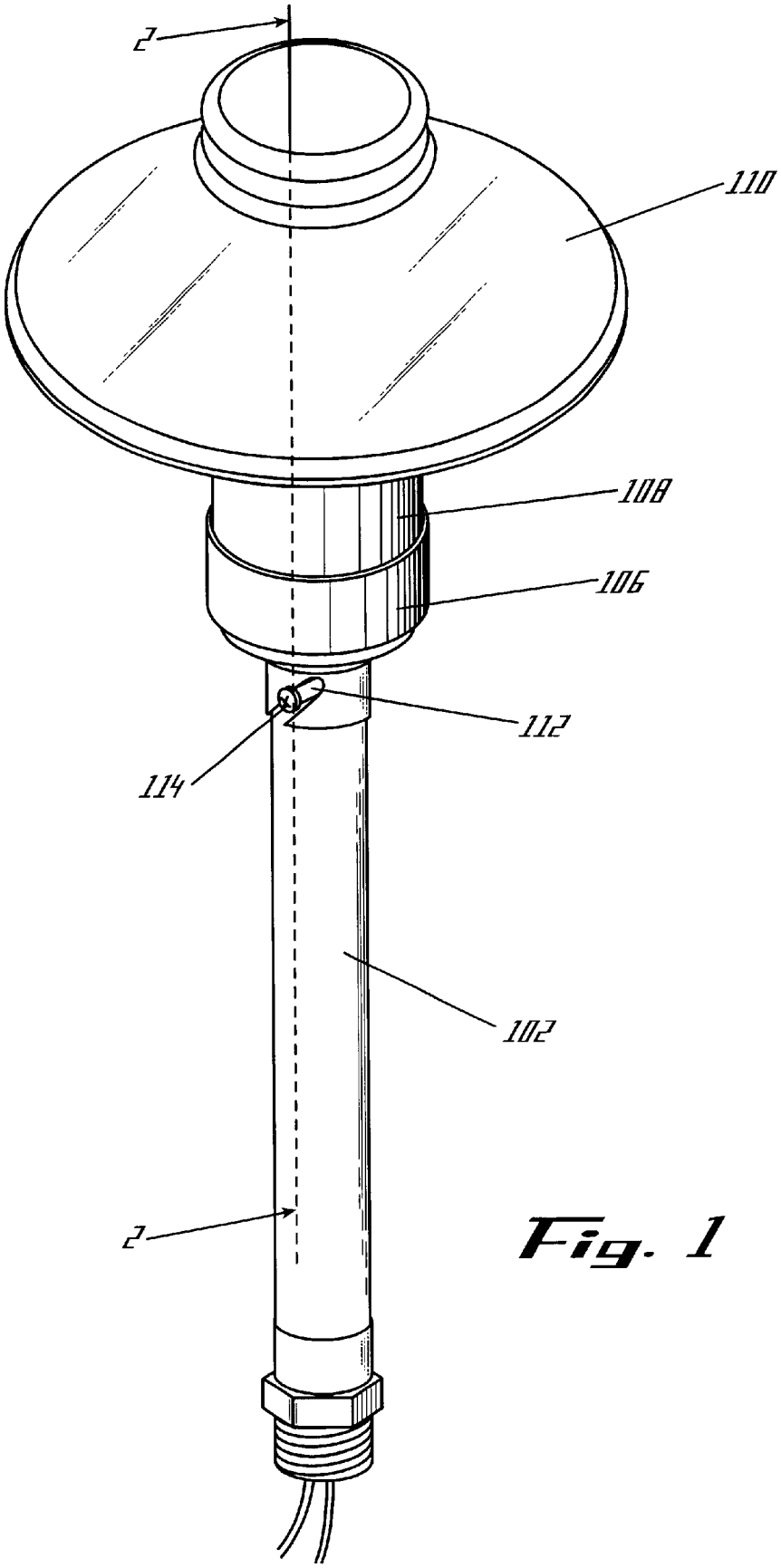
FIG. 1 is a perspective view of the lighting fixture.

FIG. 1 illustrates a lighting fixture having an adjustable beam focus generally designated by reference numeral 100. The lighting fixture 100 includes a stem in the form of a generally elongated tubular post 102 with a first end and a second end, the first end to which is attached to the lower end of the socket housing 106, a cylindrically-shaped lens 108 (not shown in FIG. 1) disposed in the upper end of socket housing 106, and a symmetrically flared reflector/reducer 110. Post 102, socket housing 106 and reducer/reflector 110 are preferably made of a durable and aesthetically pleasing material, such as copper. Other corrosion resistant materials may be used as well, including stainless steel, anodized aluminum, powder-coated or painted metal, or high temperature plastics or composites.

Figure 2:
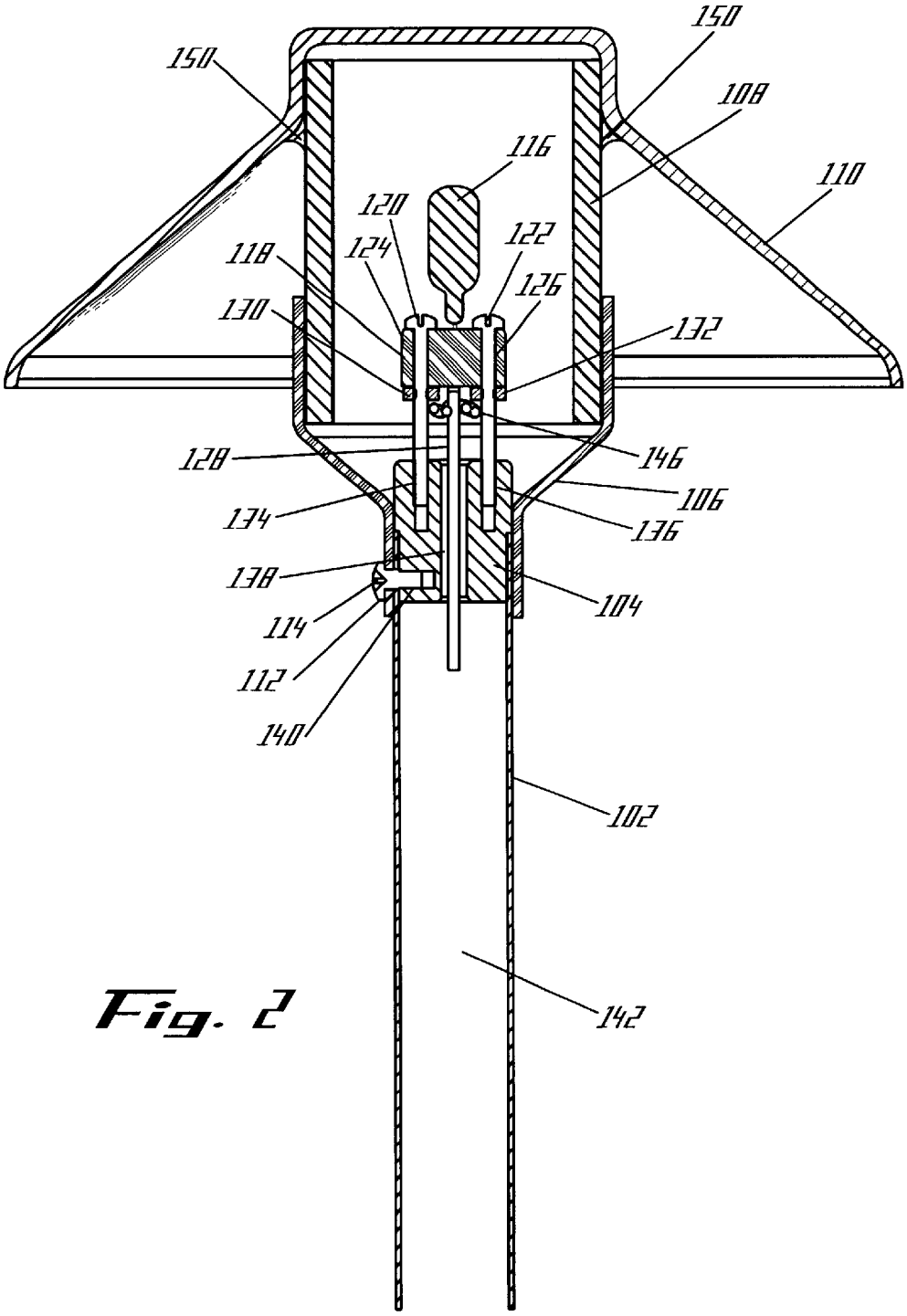
FIG. 2 is a cross-sectional view, taken along line 2—2 of FIG. 1.

The elements of lighting fixture 100 are more clearly illustrated in the cross-sectional view of FIG. 2. Tubular post 102 has a first end and a second end and a substantially hollow interior 142 where the first end forms an interference-fit around base connector 104. Base connector 104, also having a first and second end, functions to integrate many of the essential components of lighting fixture 100 into the upper end of tubular post 102 for purposes of orienting the lighting fixture in a vertical upright and aligned configuration. The lower end of socket housing 106 has a first diameter adapted to be slidably mounted over the outside of the first end of post 102. the upper end of socket housing 106 has a second diameter larger than the first diameter, and a flared center section connects the lower and upper end. Alternatively, the upper and lower sections of socket housing 106 can be stepped, or other variations can be selected to alter the aesthetics of the fixture. The second end of base connector 104 has an outer diameter adapted to be interference-fit within the inner diameter of post 102. Diagonal slot 112, in cooperation with locking screw 114, converts rotation of socket housing 106 relative to post 102 into an axial motion, whereby socket housing 106, diffuser lens 108 and reflector/reducer 110 are raised or lowered relative to tube 102. In an alternate embodiment, the slot can be straight, running along a line parallel to the longitudinal axis of the fixture. In this embodiment, socket housing 106 can be moved relative to post 102 by pulling or pushing socket housing in an axial direction.

Locking screw 114 passes through bore 144 in post 102 and threadably engages threaded bore 140 of base connector 104 to create a robust fit between the screw and threaded bore. Fasteners other than a screws may be used, to provide all or a part of the function of screw 114. For example, the fastener can be a fixed pin or peg extending from the post and base connector to provide the function of guiding the slot 112 to raise and lower the reflector relative to the lamp, however, such a fixed pin will not allow the socket housing to be tightened down to prevent movement. In such an embodiment, it may be sufficient to ensure a close fit between the inner diameter of the socket housing and the outer diameter of the post such that friction, alone, may be sufficient to strongly resist movement unless a deliberate rotational force is applied.

To provide another example, the fastener can be a spring-loaded button which releases and permits rotation or removal of the socket housing from the post only when the button is depressed. Other variations will be apparent to those of skill in the art.

In the preferred embodiment, locking screw 114 is a conventional slotted machine screw. Counter-clockwise rotation of screw 114 loosens the screw, releasing the tension exerted by the screw against socket housing 106. This release of tension allows socket housing 106 to be slidably rotated about the first end of post 102. rotation. Conversely, the clockwise rotation of screw 114 tightens the screw into threaded bore 140, locking socket housing 106 to post 102.

A cylindrical lens 108 surrounds halogen lamp 116 and has an outer diameter adapted to provide an interference fit within the upper cylinder of socket housing 106. Lens 108 can be transparent or translucent glass, plastic or like material, preferably impact resistant and capable of withstanding outside environmental conditions. In the preferred embodiment, lens 108 is a frosted, tempered glass to provide uniform diffusion and optimal tolerance of moisture, temperature and sunlight exposure. It may be desirable to use a silicone-based adhesive at the union of lens 108 and socket housing 106 to further provide a seal against moisture intrusion. Symmetrically flared reflector/reducer 110 is mounted concentrically atop lens 108 and fixed in place with the application of a silicone-based or similar adhesive 150 that can create a watertight seal. In the preferred embodiment, at least two applications of the adhesive are applied in order to seal the resulting compartment from infiltration by moisture that can accelerate corrosion of the internal components of the fixture. Due to the flexible nature of the adhesive, an ample application of adhesive can also act as a shock-absorber to reduce the possibility of lens breakage when the fixture is struck or jarred, and allows for factory-precise assembly of the lighting fixture to be maintained during field installation while still allowing access to the interior of the fixture.

Figure 3:
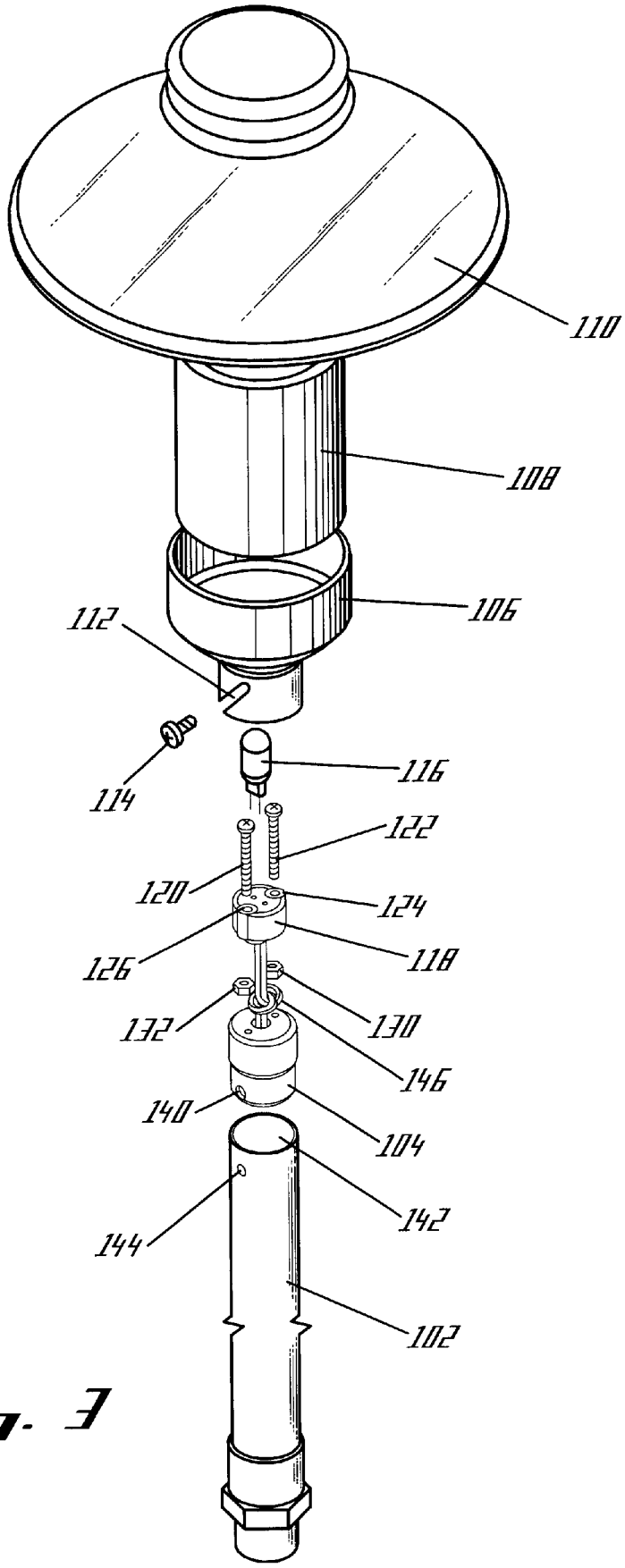
FIG. 3 is an exploded perspective view of the lighting fixture.

While FIG. 2 illustrates a cross-section of the unit lighting fixture 100, the exploded perspective view of the fixture shown in FIG. 3 more clearly depicts the individual components comprising the preferred embodiment of the invention being disclosed herein. As previously described, base connector 104 integrates many of the essential components of lighting fixture 100 with the first end of tubular post 102 for the purpose of maintaining a vertical upright orientation for the unit fixture. The union of the first end of post 102 and the second end of base connector 104 is through an interference-type fit of the two components. Additionally, alignment of smooth bore 144 and threaded bore 140 is maintained when screw 114 traverses the smooth bore and is threadably secured into the threaded bore of base connector 104.

A socket mount 118 having a first end and a second end can be formed from ceramic or other non-conductive materials well known in the electrical arts. Socket mount 118 functions as a conduit supplying electrical power to a lamp 116 which in turn is the source of illumination for the fixture. Lamp 116 is preferably a halogen filament-type lamp but can also be tungsten filament or other comparable element commonly used in commercial lighting manufacture. Socket mount 118 is connected to a voltage source through wiring 128 extending from the second end of the socket mount, passing through a centrally-located opening 138 in base connector 104, traveling the entire length of hollow interior 142 of tubular post 102 and exiting the bottom of the lighting fixture for connection to the voltage supply (not shown), which may be either a 12 V transformer or 120 V AC. In an alternate embodiment (not shown), a molded plastic ground spike is threadably connectable to the second end of tubular post 102 for securing the unit lighting fixture into the ground. In this embodiment, wiring 128 exits the second end of post 102, is threaded through an opening in the ground spike, and then continues to termination at the power source.

In order to achieve and maintain optimal vertical and horizontal positioning of lamp 116 and socket mount 118 within the interior of the lighting fixture, the socket mount is secured to the first end of base connector 104 by means of a pair of spaced socket mount screws 120, 122. Socket mount screws 120, 122 pass through spaced smooth bores 124, 126 vertically traversing socket mount 118. Having traversed the entire length of smooth bores 124, 126, the head portion of socket mount screws 120, 122 forms an abutment with the first end of socket mount 118. The remaining threaded portion of socket mount screws 120, 122 protruding from the second end of socket mount 118 are threadably securable using socket mount screw nuts 130, 132. Clockwise rotation of screws 120, 122 within screw nuts 130, 132 threadably secures the abutment between the screw heads and the first end of socket mount 118 and the screw nuts and the second end of socket mount 118. In the preferred embodiment, the threaded distal portion of socket mount screws 120, 122 are first threadably secured within opposingly spaced threaded bores 134, 136, located on the first end of base connector 104, prior to socket mount screw nuts 130, 132 are tightened around screws 120, 122. Also in the preferred embodiment, a strain relief knot 146 (shown in FIG. 2) is configured into wiring 128 traversing the space between the second end of socket mount 118 and the first end of base connector 104. Strain relief knot 146 provides means for preventing socket wires 128 from being pulled away and disconnected from socket mount 118 when the fixture is being repositioned.

The following procedure is followed to adjust the fixture to achieve a narrower, more focused beam of light: screw 114 is rotated in a counter-clockwise direction which loosens the tension exerted by the screw against the housing. This allows the user to rotate housing 106 in a counter-clockwise direction which in turn increases the vertical distance between reflector/reducer 110 and lamp 116. Slot 112, in cooperation with screw 114 converts the rotational motion to an axial motion. (In the alternate embodiment, axial motion is applied to the fixture to provide the relative motion.) Once the desired focal length of the beam is achieved, the user simply rotates screw 114 in a clockwise direction to tighten it, thus preventing the housing from being freely rotatable around tubular post 102. Conversely, when the user desires a less focused, broader spread of light, for example, to reduce glare from fixtures located on uphill views, the relative distance between reflector/reducer 110 and lamp 114 must be decreased by rotating beam adjustment housing 106 in a clockwise direction (after first loosening screw 114) to shorten the focal length of the light beam. As with the counter-clockwise rotation of housing 106, clockwise rotation is converted into axial motion by the cooperation of diagonal slot 112 and screw 114.

The lighting fixture of the present invention provides a wide range of beam control, both quality and intensity of light and glare reduction, with the entire fixture designed to resist the effects of prolonged environmental exposure. The fixture construction provides simple one screw adjustment of the beam focusing mechanism which also allows for ease of maintenance and resistance to environmental conditions and abuse once the lighting fixture is set into landscaping. The configuration of the present invention is aesthetically pleasing with clean lines and is constructed with a focus on simplicity and durability.

Other embodiments and modifications of the present invention may occur to those of ordinary skill in the art in view of these teachings. Therefore, this invention is to be limited only by the following claims which include all other such embodiments and modifications when viewed in conjunction with the above specification and accompanying drawings.

What is claimed is:

1. A lighting fixture with adjustable beam spread, comprising:

a hollow stem having an upper end and a lower end, the lower end adapted for fixed attachment in an area to be illuminated;

a lamp and a lamp socket assembly extending from the upper end of the stem;

a socket housing having an upper portion and a lower portion, the lower portion concentrically mounted on the upper end of the hollow stem to encircle the lamp and lamp socket assembly, wherein the socket housing moves axially relative to the stem for adjusting a combined axial length of the stem and the socket housing, and where the lower portion of the socket housing has an elongated slot formed therein;

a cylindrical lens having a lower portion mounted on the upper portion of the socket housing;

a reflector disposed on an upper portion of the cylindrical lens for enclosing the lamp and lamp socket; and a fastener extending radially from the upper end of the stem aligned with the slot in the socket housing, wherein the fastener cooperates with the slot to guide axial movement of the socket housing relative to the stem;

wherein the socket housing, cylindrical lens and reflector move axially relative to the stem and the lamp and lamp socket assembly to adjust the beam spread over the area to be illuminated.

2. The lighting fixture of claim 1, wherein the lamp and lamp socket assembly comprise:

a base connector disposed within the stem;

a lamp socket connected to the base connector and having electrical wires extending therefrom and through the base connector into the stem; and a lamp plugged into the lamp socket.

3. The lighting fixture of claim 2, wherein the electrical wires have a knot formed therein between the base connector and the lamp socket.

4. The lighting fixture of claim 1, wherein the slot is disposed at a diagonal relative to a longitudinal axis of the stem, wherein rotation of the socket housing relative to the stem is converted by cooperation between the fastener and the slot into an axial motion so that the socket housing, cylindrical lens and reflector are moved relative to the lamp and lamp socket assembly.

5. The lighting fixture of claim 1, wherein the reflector is sealed to the upper portion of the cylindrical lens using a watertight sealant.

6. The lighting fixture of claim 5, wherein the watertight sealant is flexible.

7. The lighting fixture of claim 6, wherein the watertight sealant is a silicone-based sealant.

8. The lighting fixture of claim 1, wherein the cylindrical lens comprises a diffuser.

9. The lighting fixture of claim 8, wherein the cylindrical lens comprises frosted tempered glass.

10. The lighting fixture of claim 1, wherein the lamp of the lamp and lamp socket assembly is a halogen lamp.

11. The lighting fixture of claim 1, wherein the fastener is a screw, and tightening of the screw prevents movement of the socket housing relative to the stem.

12. A lighting fixture with adjustable beam spread, comprising:

a lamp;

a lamp socket assembly mounted on a stem for receiving the lamp, wherein the stem is fixedly attached in an area to be illuminated;

a fastener extending radially from a side of the lamp socket assembly;

a socket housing concentrically disposed on the stem and having a cylindrical lens extending therefrom and encircling the lamp, the socket housing having a lower portion adapted to slidably and rotatably fit over the lamp socket assembly so that a combined axial length of the socket housing and stem is adjustable;

an elongated slot disposed in the lower portion of the socket housing and aligned with the fastener, wherein the fastener cooperates with the slot to guide axial movement of the socket housing relative to the stem; and a reflector disposed on an upper portion of the cylindrical lens;

wherein the socket housing, cylindrical lens and reflector move axially relative to the stem and the lamp and lamp socket assembly to change a distance between the lamp and the reflector whereby the beam spread over the area to be illuminated is adjusted.

13. The lighting fixture of claim 12, wherein the lamp socket assembly comprises:

a base connector disposed within the stem;

a lamp socket connected to the base connector and having electrical wires extending therefrom and through the base connector into the stem; and a lamp plugged into the lamp socket.

14. The lighting fixture of claim 13, wherein the electrical wires have a knot formed therein between the base connector and the lamp socket.

15. The lighting fixture of claim 12, wherein the slot is disposed at a diagonal relative to a longitudinal axis of the stem, wherein rotation of the socket housing relative to the stem is converted by cooperation between the fastener and the slot into an axial motion so that the socket housing, cylindrical lens and reflector are moved relative to the lamp and lamp socket assembly.

16. The lighting fixture of claim 12, wherein the reflector is sealed to the upper portion of the cylindrical lens using a watertight sealant.

17. The lighting fixture of claim 16, wherein the watertight sealant is flexible.

18. The lighting fixture of claim 17, wherein the watertight sealant is a silicone-based sealant.

19. The lighting fixture of claim 12, wherein the cylindrical lens comprises a diffuser.

20. The lighting fixture of claim 19, wherein the cylindrical lens comprises frosted tempered glass.

21. The lighting fixture of claim 12, wherein the lamp of the lamp and lamp socket assembly is a halogen lamp.

22. The lighting fixture of claim 12, wherein the fastener is a screw, and tightening of the screw prevents movement of the socket housing relative to the stem.

* * * * *